United States Patent [19]

Rahn et al.

[11] 4,144,051

[45] Mar. 13, 1979

[54] PROCESS FOR THERMALLY TREATING SOLIDS WITH HIGH-OXYGEN GASES, ESPECIALLY FOR PYROMETALLURGICAL APPLICATIONS

[75] Inventors: Martin Rahn, Frankfurt am Main; Lothar Reh, Bergen-Enkheim; Bernd Thöne, Friedberg; Karel Vydra, Bad Nauheim, all of Fed. Rep. of Germany

[73] Assignees: Metallgesellschaft Aktiengesellschaft, Frankfurt am Main; Deutsche Babcock Aktiengesellschaft, Oberhausen, both of Fed. Rep. of Germany

[21] Appl. No.: 823,856

[22] Filed: Aug. 11, 1977

[30] Foreign Application Priority Data

Apr. 12, 1977 [DE] Fed. Rep. of Germany ..... 2716082

[51] Int. Cl.[2] ..... C21B 1/02

[52] U.S. Cl. ..... 75/9

[58] Field of Search ..... 75/9, 26, 40

[56] References Cited

U.S. PATENT DOCUMENTS

| | | | |
|---|---|---|---|
| 3,915,692 | 10/1975 | Herbert et al. | 75/26 |
| 4,017,307 | 4/1977 | Winterhager et al. | 75/26 |

*Primary Examiner*—M. J. Andrews

*Attorney, Agent, or Firm*—Karl F. Ross

[57] ABSTRACT

A process for thermally treating fine-grained solids with high-oxygen gases at temperatures at which the solids can form molten and gaseous reaction products comprises carrying out the thermal treatment in a cyclone chamber and thereafter conducting the gases from the cyclone chamber into a horizontal or vertical cooling chamber. The process can be used for the roasting of sulfide ores, ore concentrates and other metallurgical intermediate products. The outlet of the cyclone chamber through which the gases are removed lies approximately along the axis and cooling is carried out in the cooling chamber such that the molten droplets contained in the gas stream entering the latter are cooled in free flight below their solidification point in the gas, i.e., do not contact the walls of the cooling chamber until they are solidified at least along their surfaces.

14 Claims, 5 Drawing Figures

PROCESS FOR THERMALLY TREATING SOLIDS WITH HIGH-OXYGEN GASES, ESPECIALLY FOR PYROMETALLURGICAL APPLICATIONS

FIELD OF THE INVENTION

The present invention relates to a process for thermally treating fine-grained solids with high-oxygen gases at temperatures at which the solids can form molten and gaseous products. The invention also relates to a method of operating an apparatus useful in pyrometallurgical processes, e.g., the roasting of sulfide ores, ore concentrates or other metallurgical intermediates.

BACKGROUND OF THE INVENTION

In various pyrometallurgical processes, attention has centered of late upon the use of a cyclone chamber into which the fine-grained solids, high-oxygen gases and, if desired, an energy carrier such as a fuel are introduced to undergo reaction.

Cyclones of this type have found application in combustion installations, e.g., furnaces, as well as in pyrometallurgy. Various systems using such cyclones are described in the following publications: "*Lexikon der Technik,*" vol. 7, "*Lexikon der Energietechnik und Kraftmaschinen,*" L-Z, Deutsche Verlagsanstalt Stuttgart, 1965; I.A. Onajew "*Zyklonschmelzen von Kupfer und polymetallischen Konzentraten,*" Neue Hütte 10, 1965, pages 210 et seq.; Printed German Applications (Auslegeschrift) Nos. 11 61 033, 19 07 204, and 20 10 872; Open German Specification (Offenlegungsschrift) No. 21 09 350; Sch. Tschokin, *Freiburger Forschungshefte B*150, Leipzig, 1969, pages 41 et seq.; G. Melcher et al. and E. Müller in *Erzmetall,* vol. 28, 1975, pages 313 et seq., vol. 29, 1976, pages 322 et seq., vol. 30, 1977, pages 54 et seq.

The reason why cyclone chambers have been found to be especially effective in pyrometallurgical treatments, and, more generally, for carrying out reactions in which an oxygen-containing gas participates, is that the throughput of the cyclone per unit of reactor volume is high compared to other solid/gas treatment systems. High reaction temperatures can be obtained, thereby permitting volatilization of various components of the solid feed.

There is described in printed German Application (Auslegeschrift) No. 22 53 074, see U.S. Pat. No. 3,915,692, a technique which utilizes a cyclone chamber and which ensures that the reactants are intensely mixed and are caused to react to a considerable extent in a vertical combustion path before entering the cyclone chamber. This system provides a vertical combustion path at the inlet to the cyclone chamber.

The advantage of this system over the operation of a cyclone chamber without a combustion path ahead of the chamber is that is precludes a separation of particles of the feed solid in the cyclone chamber and the entrapment of the separated solids in the molten film which lines the wall of the cyclone chamber and which might prevent these particles from participating in the reaction.

In spite of the advantages of the cyclone chamber, particularly when the latter is operated as described in German Auslegeschrift (printed application) No. 22 53 074, difficulties have been encountered in some cases with the separation of the molten droplets which are entrained by the gases leaving the cyclone chamber. Particularly in pyrometallurgical processes, the collecting surfaces, which are water-cooled grates in most cases, tend to be clogged quickly because the gas entering the cyclone chamber and the gas leaving the cyclone chamber have high loading rates.

OBJECTS OF THE INVENTION

It is the principal object of the present invention to provide a process for the treatment of solids, especially with high-oxygen gases, using a cyclone chamber whereby the aforementioned disadvantages are obviated.

It is another object of this invention to provide a process for the purposes described which is relatively simple and does not require expensive apparatus.

Yet another object of the invention is to provide an improved installation for the thermal treatment of solids whereby disadvantages of earlier systems can be obviated and the apparatus is of relatively low cost and high effectivity, and which further improves upon the system described in German Auslegeschrift No. 22 53 074, see U.S. Pat. No. 3,915,692.

Still another object of this invention is to provide an improved method of operating a plant or apparatus for the treatment of solids, especially in the carrying out of pyrometallurgical processes.

It is yet another object of this invention to provide a pyrometallurgical treatment for solids, especially for the roasting of sulfide ores, ore concentrates and other metallurgical intermediate products, which precludes caking up of the cooling means, is of particularly high efficiency and can be carried out in a simple manner in relatively inexpensive apparatus.

SUMMARY OF THE INVENTION

These objects and others which will become apparent hereinafter are attained, in accordance with the present invention, by providing downstream of the cyclone chamber, which can otherwise be of the type described in U.S. Pat. No. 3,915,692, a cooling chamber which communicates with the cyclone chamber through an opening in an end wall of the cyclone chamber aligned with the axis thereof, the cooling chamber being dimensioned and operated such that the molten droplets contained in the gas stream entering the cooling chamber are cooled below their solidification point (melting point) while they are in free flight (entrained by the gas stream), thereby ensuring that the solidifiable materials will have been sufficiently solidified, e.g., at least superficially, before they contact any solid surfaces within the cooling chamber, e.g., the walls thereof.

The cooling chamber is connected to the cyclone chamber by a transfer passage which has a length of 0.5D to 5D, preferably 1 to 2D, where D is the diameter of the outlet opening in the end wall of the cyclone chamber. The cooling chamber may have a horizontal axis or a vertical axis. When reference is made herein to a substantially horizontal axis, it will be understood that this is intended to refer to an axis which is horizontal or inclined upwardly from the horizontal by an angle up to about 15°.

Since the cyclone chamber has a horizontal axis, according to the invention, the use of a vertical cooling chamber requires that the gas flow be deflected by about 90°. The deflection will be exactly 90° if the axis of the cyclone is precisely horizontal but may be less than 90°, e.g., as little as 75°, if the axis of the cyclone chamber is substantially horizontal. The cooling chamber should be symmetrical with respect to a vertical plane which includes the axis of the cyclone chamber and may be of rectangular, circular, elliptical or polygonal cross section.

When a cooling chamber has a horizontal axis or a substantially horizontal axis, we have found that the chamber should have a cross-sectional area that is at least 5.5 times and preferably 10 to 30 times the cross-sectional area of the aforementioned outlet opening in the end wall of the cyclone chamber, i.e., at least $5.5 \times \pi R^2$, where $R = D/2$.

Smaller dimensions are sufficient in a cooling chamber which has a vertical axis because the molten and solid particles do not move along a parabolic trajectory. In this case, the cross-sectional area should be at least 4.5 times, preferably 8 to 25 times, the cross-sectional area of the discharge opening in the end wall of the cyclone chamber. In all cases, the outlet opening should have a diameter which is not less than 0.3 meters.

The use of cooling chambers having the stated dimensions, both for the vertical and substantially horizontal cooling chamber, ensures that initially molten particles will have completely solidified at least on their surface before contacting the walls of the cooling chamber so that these particles cannot adhere to the wall of the cooling chamber and the particles will fall to the bottom of the cooling chamber and can be removed therefrom in a simple manner by means of a conveyor, e.g., a cooled screw conveyor.

To facilitate removal of the solidified product in a process in which a horizontal cooling chamber is used, the cooling chamber has a cross-sectional configuration which consists of a rectangle on its upper side and a downwardly converging trapezoid on its lower side, the trapezoid having its small base at the bottom of the cooling chamber. In this case, the trapezoidal portion of the cooling chamber constitutes a funnel which directs the solids downwardly. The length L of the cooling chamber should be between $3\sqrt{F}$ and $10\sqrt{F}$ where F is the cross-sectional area of the cooling chamber.

The gas can be cooled in the cooling chamber by water-cooled or vapor-cooled (steam-cooled) chamber walls or by the addition of gaseous or aqueous fluids to the gas stream admitted by the transfer passage from the cyclone chamber into the cooling chamber.

Naturally, both cooled chamber walls and the addition of fluids to the gas may be used.

If the cooling is to be carried out be the addition of a cold gas to the hot gas stream from the cyclone chamber, the momentums of the gas leaving the cyclone chamber and the added gas can be utilized for thorough mixing. The mixing of the components has been found to be particularly effective when the gas jet leaving the transfer passage enters the cooling chamber at a velocity between 30 and 300 meters/second, preferably between 50 and 120 meters/second. The use of high flow velocities of the magnitude stated and of cooling chambers having dimensions as given above has been found to result in a recirculating flow which is symmetrical to the axis of the cooling chamber. Recirculation and cooling is intensified when the cooling fluid is fed into the recirculating flow.

We have found that a surprisingly effective cooling can be accomplished when the cooling fluid is added to the gas entering the cooling chamber from these cyclone chambers through a plurality of openings having outlet directions lying in the surface of an imaginary cone having an included angle of 30° to 160°, an axis coinciding with the axis of the transfer passage and an apex which is turned in the downstream direction, i.e. which points in the direction of flow.

Cooling using added fluids can be accompanied, according to a particularly advantageous feature of the invention, by simultaneous chemical reactions. For example, we may control the parameters of the cyclone chamber so that the gas emerging therefrom has a high carbon monoxide content, the gas being transformed into water gas in the cooling chamber by the use of water vapor or liquid water as the cooling medium.

When a pyrometallurgical process is carried out in the cyclone chamber and involves a roasting of sulfide ores or ore concentrates, the gas stream may contain sulfur dioxide and the cooling medium can be waste sulfuric acid which is decomposed by the sulfur dioxide containing gas. Advantageously, the cooling is carried out such that the temperature of the gas stream leaving the cyclone chamber is lowered to a temperature which is about 100° C. below the softening point of the molten particles. This usually requires a cooling to a temperature between 600° and 1200° C. which will ensure that the particles are sufficiently solidified before they come into contact with the wall of the cooling chamber.

The transfer passage between the cyclone chamber and the cooling chamber may be cylindrical or frustoconical or a combination of shapes. If a frustoconical passage is used, the frustocone may flare in the direction of flow of the gas or in a direction opposite to the direction of flow thereof.

When molten material drips from the transfer passage, because of accumulations on the surfaces of the walls of the transfer passages or the like, we provide a water-flooded duct or a water-cooled duct directly below the outlet opening of the transfer passage to collect such molten material dripping therefrom and for carrying off the solidified product through this duct. The duct can be an upwardly open trough disposed below the transfer passage.

According to a preferred feature of the invention, the solids to be processed, the high-oxygen gas, and, if desired, energy carriers are mixed to form a suspension at a temperature below the reaction temperature, the suspension being fed into a vertical combustion path at a velocity which precludes backfiring. The suspension is reacted in the combustion path to form a suspension which contains mainly molten particles as it is introduced at high velocity into the cyclone chamber. The residence time in the vertical combustion path is selected such that reaction of the suspension is at least 80% complete at the time the suspension enters the cyclone chamber. Various methods may be adopted to supply the suspension to the cyclone chamber at a velocity which precludes backfiring. For instance, the reactants may be admixed in such manner that the suspension has a high velocity at its introduction to the vertical combustion path. Alternatively, the components of the suspension may be introduced through nozzles or orifices which prevent backfiring and provide the necessary velocity. It is particularly desirable to provide ahead of the combustion path a charging device with a nozzle-like constriction and which effects the acceleration to a sufficiently high velocity. This tends to eliminate streaking and agglomerates which otherwise tend to form in the suspension. The suspension is completely homogenized so that the particle surfaces is fully utilized for the reaction. A nozzle of the type described in U.S. Pat. No. 3,915,692 may be used.

The residence time of the suspension in the combustion path is controlled by selection of suitable dimensions. The velocity of gas in the combustion path, calculated for the empty tube, is 8 to 30 meters/second according to the invention. The solid particles which have been mixed to form the suspension and are thus fed to the combustion path should have a specific area of 10 to 100 $m^2/kg$, preferably 40 to 300 $m^2/kg$, corresponding to a median particle diameter of 3 to 300 microns, preferably 10 to 80 microns, the median particle diameter being defined as the diameter of above and below which 50% by weight of the solids are found.

The high-oxygen gases which are used according to the present invention are gases which contain at least 30% by volume oxygen. If such high-oxygen gases are not available, they can be prepared by mixing oxygen of high concentration with air and/or other gases. The high-oxygen gases may be formed directly in the step of mixing and the solids in finely divided form with the oxygen, with the air, or with any other gases or in a previous step in the absence of the solids.

If the reaction between the solids to be treated in the process of the invention and the high-oxygen gases is endothermic or is not sufficiently endothermic that the process proceeds autonomously, any desired energy carrier may be added in the cyclone chamber, in the combustion chamber or between the two. The energy carrier may also be admixed with the high-oxygen gas before it is introduced into the cyclone chamber.

An energy carrier, according to the invention, is any substance which will generate heat when reacted with oxygen. More specifically, the energy carrier is a fuel which can be in a gaseous, liquid or solid state, or a mixture of fuels in more than one of these states.

When an energy carrier is used, it is desirable, according to the invention, to premix gaseous fuel and high-oxygen gases, to premix solid fuels with the fine grain solids to be treated, and to inject a liquid fuel into the gas stream so as to atomize the liquid therewith. Materials which are noncarbonaceous and generate heat when reacted with oxygen may also be used. Such noncarbonaceous energy carriers include pyrites and sulfur. Naturally, the fuel which is used must be selected so as not to adversely effect the pyrometallurgical reaction which is desired.

According to the invention, at least 85% of the molten material which has been formed is recovered directly from the cyclone chamber while 15% or less of the molten material is entrained with the gas. Two cyclone chambers may feed a common cooling chamber. The process of the invention is especially advantageous for pyrometallurgical treatment, particularly for the roasting of sulfide ores, ore concentrates and like metallurgical intermediates.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
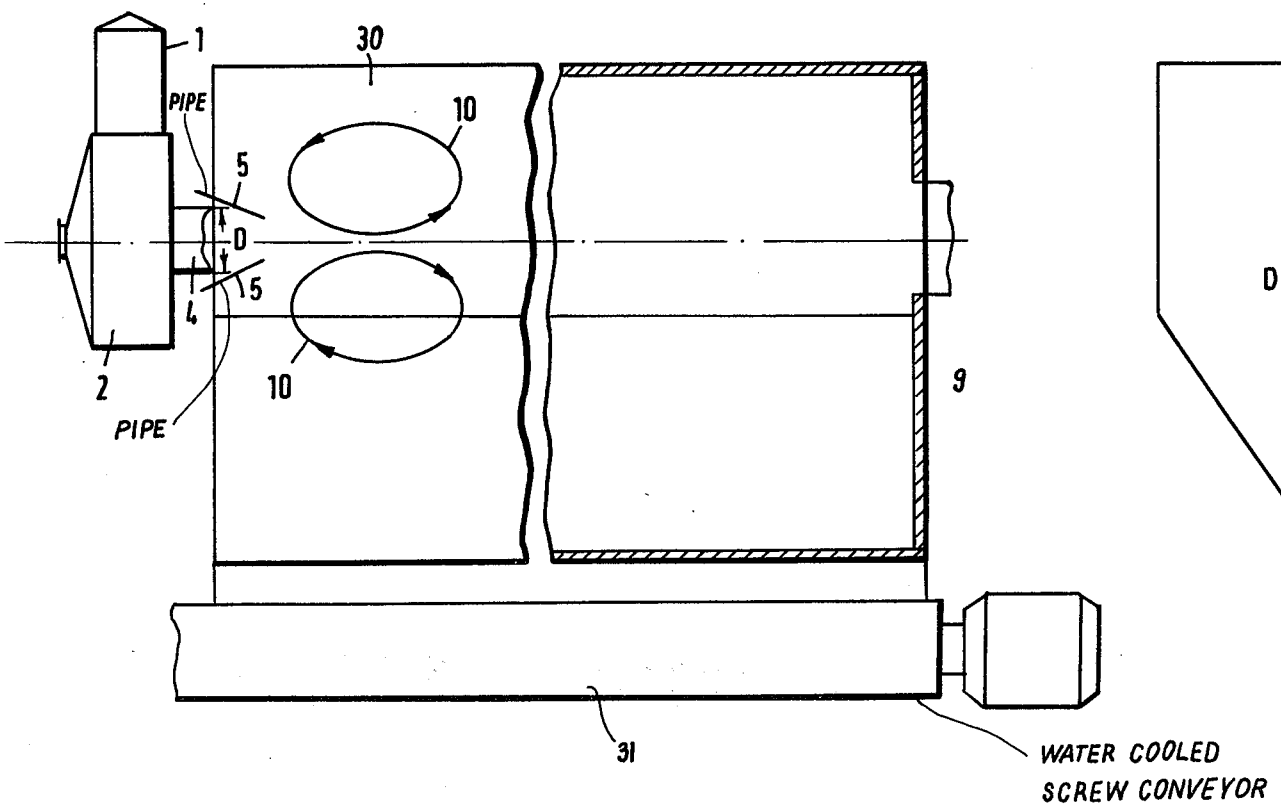
FIG. 1 is a diagram illustrating a cyclone chamber having a horizontal cooling chamber according to the invention.

In FIG. 1 we have shown a cyclone chamber 2 provided with a combustion path 1 as described in U.S. Pat. No. 3,915,692 and connected by a transfer passage 4 to the front wall of a horizontal cooling chamber 30 which has a horizontal axis. Gaseous or liquid cooling fluid is supplied through conduits 5. As shown in cross section in FIG. 2, the cooling chamber can consist of a rectangular parallelepipedal upper portion 3' having a rectangular cross section and a prismatic lower portion having a trapezoidal cross section as shown in 3''. The inlet of the transfer passage 4 is indicated by broken lines in FIG. 2 and has the diameter D. A water cooled screw conveyor 31 can be provided at the base of the trapezoidal-section portion to carry away the solids.

Figure 3:
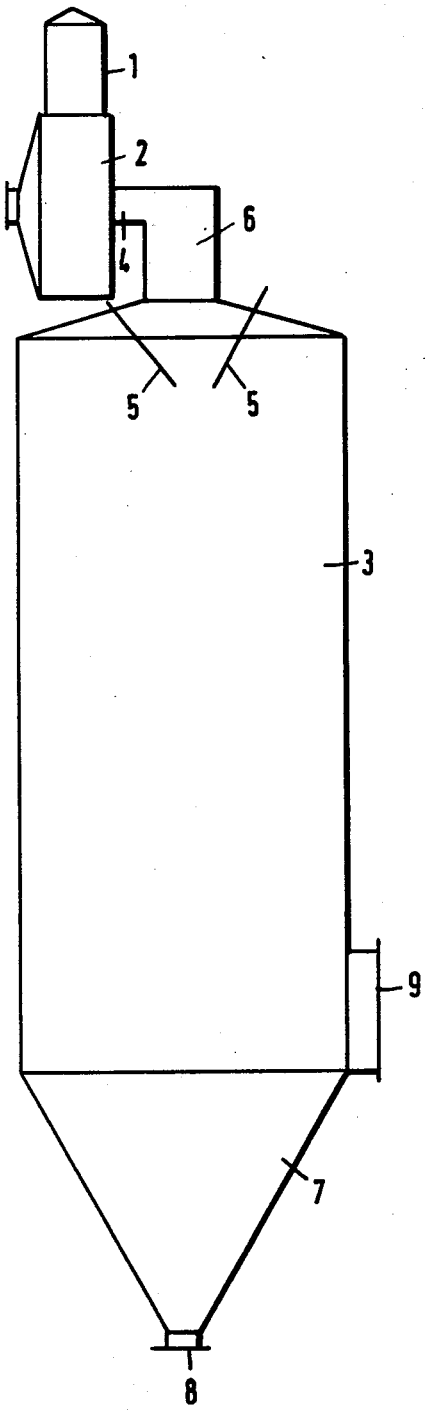
FIG. 3 is a view similar to FIG. 1 but illustrating the use of a cyclone with a vertical cooling chamber.

In the embodiment of FIG. 3, the combustion path and cyclone chamber 2 are connected to a cooling chamber 3 by a transfer passage 4 formed with a bend 6. Cooling fluid is again introduced through conduits 5.

Figure 4:
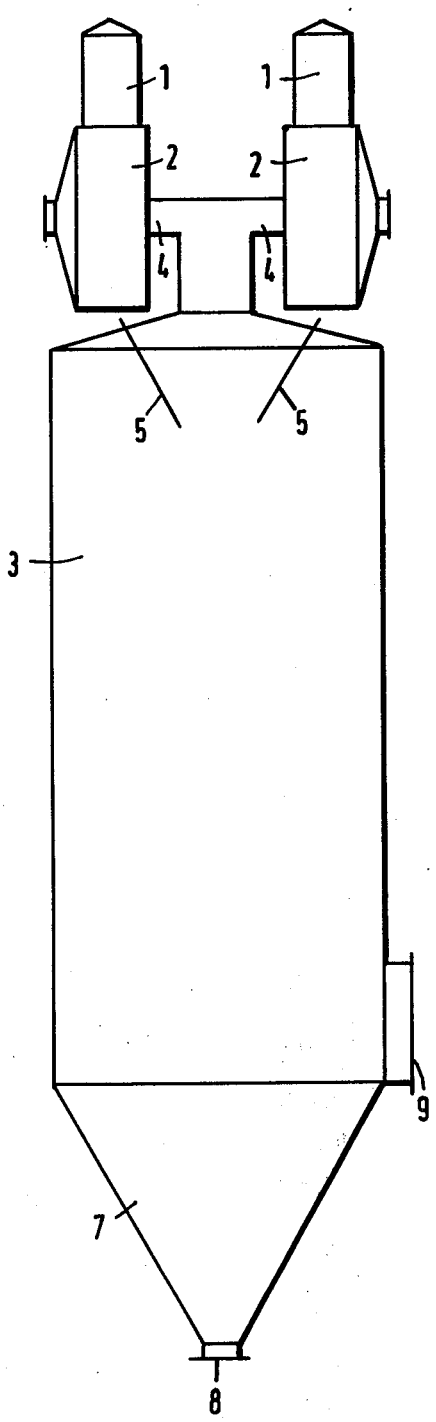
FIG. 4 shows the application of a single cooling chamber to two cyclones.

FIG. 4 shows an embodiment of the invention in which two cyclone chambers 2, each having a respective combustion path 1, communicates with a common cooling chamber 3 via respective transfer passages 4.

The cooling chambers 3 shown in FIGS. 3 and 4 are of circular cross section and, to facilitate the removal of particles which have solidified in free flight in the cooling chamber, a discharge cone 7 is provided with an outlet opening 8 at the lower end of each cooling chamber. The gas outlet in FIGS. 1, 3 and 4 is represented at 9. In FIG. 1 the recirculating swirl has been illustrated at 10.

Figure 5:
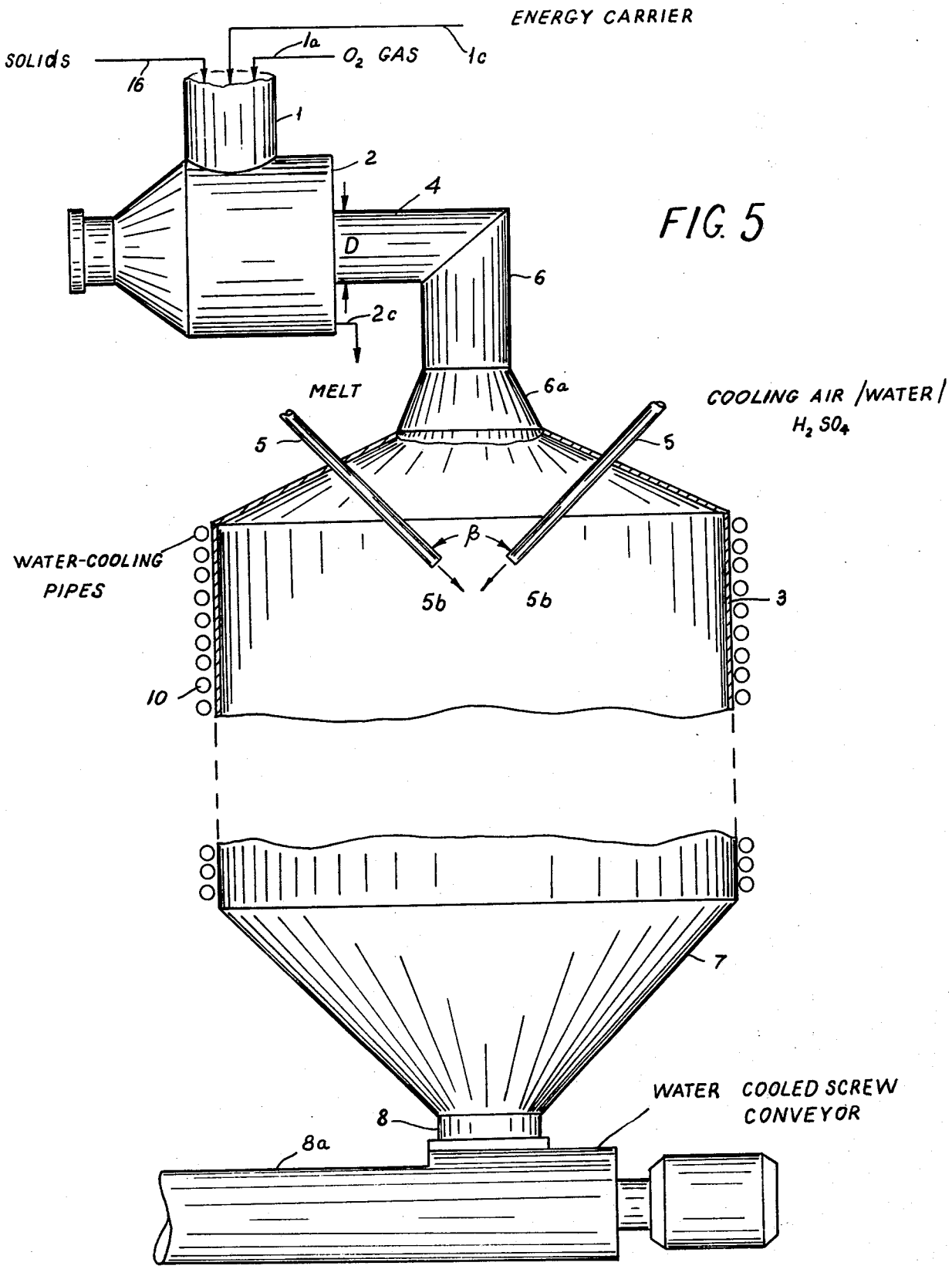
FIG. 5 is a less diagrammatic but fragmentary view illustrating features of the invention.

FIG. 5 shows an embodiment generally similar to FIG. 3 although the principles thereof are equally applicable to FIG. 4 and, as described previously, to the embodiment of FIGS. 1 and 2.

To the combustion path 1, which can be formed with a constricting nozzle, a suspension can be supplied so that the solids added at 1*b*, the oxygen-containing gas added at 1*a* and the energy carrier supplied at 1*c* can react to at least 80% of completion before the suspension enters the cyclone chamber 2. The melt is recovered from the shell of the cyclone chamber as shown at 2*c*.

The bend 6 can communicate with a frustoconically diverging section 6*a* which opens into the upper end of the vertical cooling chamber 3 over only a fraction of the flow cross section thereof. The cooling fluid can be introduced through the pipes 5 which can have orifices 5*b* which likewise open along the surface of the cone but in the direction of gas flow. The apex angle B is between 30° and 160° as noted previously.

The wall of the cooling chamber 3 can be provided with a layer of water cooling pipes 20 when a water-cooled wall is desired. The water from the pipes 20 can be transformed into steam for use elsewhere in the metallurgical plant.

A water-cooled screw conveyor 8*a* is provided at the base of the funnel 7. Naturally, the apparatus illustrated at FIG. 5 operates similarly to the embodiments illustrated in FIGS. 3 and 5.

SPECIFIC EXAMPLES

Figure 2:
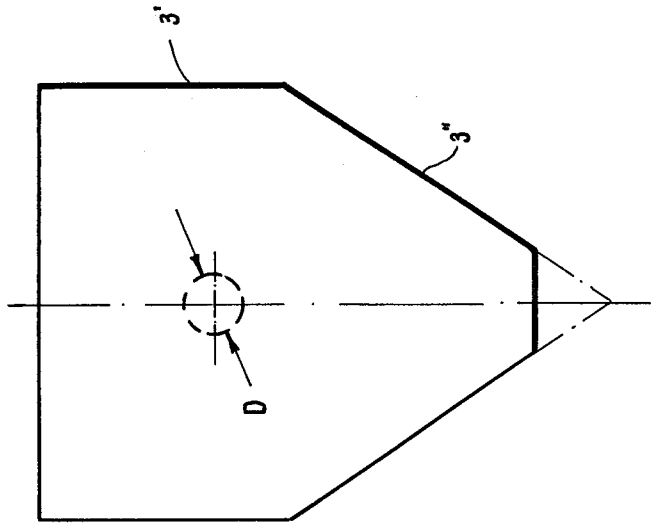
FIG. 2 is a sectional view showing the cooling chamber of FIG. 1 in a vertical section taken transverse to the axis thereof.

1. A plant was used as illustrated in FIGS. 1 and 2 with a radiant cooling chamber. The combustion path 1 had a diameter of 0.400 meters and a length of 1.3 meters. The cyclone chamber 2 had a diameter of 1.3 meters and a length of 0.93 meters. The rectangular cross section of the cooling chamber 3 had side lengths of 2.1 × 1.3 meters and the trapezoidal cross section had a height of 1.3 meters and a short side length of 0.48 meters. The axial length of the cooling chamber was 12.5 meters. The diameter of the outlet opening of the cyclone chamber 2 and of the transfer passage 4 was 0.520 meters and the transfer passage 4 had a length of 0.6 meters.

Pyrite concentrate containing 40% by weight iron, 46% by weight sulfur, 1% by weight zinc, 0.6% by weight lead, and having a median particle diameter of 25 microns was mixed at a rate of 6120 kg/h with an oxygen-containing gas containing 40% by volume oxygen, balance nitrogen, which was supplied at a rate of 7480 $m^3$/h (STP). The homogeneous suspension was fed to and reacted in the combustion path 1. The products of the reaction were substantially FeO and sulfur dioxide. The resulting calcine was recovered in a molten state from the cyclone through an opening in the shell at a rate of 3650 kg/h and granulated in water. The mean temperature within the cyclone was 1620° C.

Exhaust gas from the cyclone chamber 2 at a rate of 7380 $m^3$/h (STP) was delivered to the cooling chamber 3. The exhaust gas contained 27 volume percent sulfur dioxide, 6.2 volume percent water vapor, 6.7 volume percent oxygen, balance nitrogen, and was at a temperature of approximately 1620° C.

The exhaust gas was supplied through the transfer passage 4 and was contacted in the cooling chamber with waste sulfuric acid at a temperature of 50° C. and an acid concentration of 65% by weight $H_2SO_4$. The sulfuric acid was supplied at a rate of 2900 kg/h through the pipes 5. The acid was decomposed and resulted in a cooling of the gas to 900° C. The gas leaving the cooling chamber had the following composition: 24.7 volume percent sulfur dioxide, 22 volume percent water vapor, 7.3 volume percent oxygen, balance nitrogen. The gas was discharged through outlet 9 at a rate of 9760 $m^3$/h (STP). Flowable dust was withdrawn from the bottom of the cooling chamber 3 at a rate of 100 kg/h by means of a cooled screw conveyor. No caking could be detected in the cooling chamber.

2. The plant described in Example 1 was used. Instead of radiation cooling, the cooling chamber 3 was forcibly cooled with water. Copper concentrate consisting of 28.6% by weight copper, 29.3% by weight iron, 33.4% by weight sulfur, 6.0% by weight $SiO_2$, balance impurities such as nickel, arsenic, antimony, calcium oxide, alumina and magnesia was processed at a rate of 10900 kg/h. The copper concentrate was mixed with sand in an amount of 1.850 kg/h, limestone in an amount of 400 kg/h, fine dust recovered from the cooling chamber at a rate of 600 kg/h and oxygen-containing gas at 20° C. consisting of 50% by volume oxygen, balance nitrogen, at a rate of 5340 $m^3$/h. The suspension was fed to the combustion path 1 and reacted to form copper matte, slag and sulfur dioxide containing gas. The feed solids were premixed before introduction into the gas to form a mixture having a median particle diameter of 50 microns. The liquid phase, consisting of copper matte and slag, was recovered at shell outlet 2c at a rate of 11200 kg/h and was introduced into a hearth in which the molten phases were separated. The mean temperature in the cyclone chamber 2 was about 1600° C.

The exhaust gas, which was also about 1600° C., was fed at a rate of 4680 $m^3$/h through the outlet opening of the cyclone chamber 2 and the transfer passage 4 into the cooling chamber 3. The exhaust gas consisted of 40 volume percent sulfur dioxide, 3 volume percent oxygen, balance nitrogen.

The gas temperature was lowered to 800° C. by the water-cooled walls of the cooling chamber. The molten particles entered with the exhaust gas from the cyclone chamber and solidified in free flight, depositing in a flowable powder on the bottom of the cooling chamber. The particles were removed at a rate of 600 kg/h with a cooled screw conveyor and recycled to the combustion path as indicated. No caking was observed in the cooling chamber 3.

A similar procedure was carried out with the cooling system of FIG. 3 with comparable results.

We claim:

1. A process for thermally treating particulate solids with a high-oxygen gas, comprising the steps of:

reacting said particulate solids with said gas at least in part in a cyclone chamber have a substantially horizontal axis and an outlet in an end wall thereof:

recovering a molten product from said cyclone through an opening in the lower portion of the shell and discharging gas entraining a minor portion of said molten product through said outlet;

introducing said gas into a cooling chamber; and cooling said gas in said cooling chamber to a temperature below the solidification temperature of said droplet, the velocity of the gas entering said cooling chamber and the dimensions of said cooling chamber being selected to ensure complete solidification of at least the surface of said droplets in free flight before contact of said droplets with a wall of said cooling chamber, said cooling chamber having a length L which is between $3 \times \sqrt{F}$ and $10 \times \sqrt{F}$ wherein F is the cross-sectional area of said cooling chamber.

2. The process defined in claim 1 wherein said gas stream is fed into a cooling chamber having a substantially horizontal axis and a cross-sectional area which is at least 5.5 times the cross-sectional area of said outlet.

3. The process defined in claim 2 wherein the cross-sectional area of said cooling chamber is 10 to 30 times the cross-sectional area of said outlet.

4. The process defined in claim 1 wherein said gas stream is fed into a vertical cooling chamber, said cooling chamber having a cross-sectional area of at least 4.5. times the cross-sectional area of said outlet.

5. The process defined in claim 4 wherein the cross-sectional area of said cooling chamber is 8 to 25 times the cross-sectional area of said outlet.

6. A method of operating a reactor in which a particulate solid is reacted with a high-oxygen gas, said method comprising the steps of:

(a) reacting said solid with said gas in a vertical combustion tube to at least 80% of reaction completion to form a suspension containing mainly molten droplets and gas;

(b) introducing said suspension in a cyclone chamber and completing the reaction therein;

(c) recovering metallurgical melt from said cyclone chamber through an opening in the lower portion of the shell;

(d) discharging through an outlet in an end wall of said cyclone chamber a gas stream entraining molten droplets;

(e) introducing said gas stream entraining molten droplets into a cooling chamber, the dimensions of said cooling chamber being sufficient to effect cooling of at least the surfaces of said droplets below the softening temperature thereof while said droplets are in free flight and before said droplets contact a wall of said cooling chamber; and (f) recovering flowable solid particles from said cooling chamber.

7. The process defined in claim 1, further comprising the step of fluid-cooling at least one wall of said cooling chamber.

8. The process defined in claim 1, further comprising the step of adding a cooling fluid to said gas stream upon its entry into said cooling chamber, said fluid and said gas stream mixing with large momentum.

9. The process defined in claim 8, further comprising the step of introducing said cooling fluid into the recirculating flow of said gas stream formed in said cooling chamber.

10. The process defined in claim 8 wherein said fluid is introduced into said gas stream through a plurality of openings having outlet directions disposed on a conical surface of a cone having an included angle of 30° to 160°.

11. The process defined in claim 1 wherein cooling is carried out in said cooling chamber to a temperature which is about 100° C. below the softening point of said droplets.

12. The process defined in claim 1, further comprising the step of reacting said suspension at least 80% to completion in a vertical combustion path opening into said cyclone chamber.

13. The process defined in claim 12 wherein said solids, said gas stream and an energy carrier, if necessary, are mixed to form said suspension at a temperature below the reaction temperature thereof, said suspension is thereafter reacted in said vertical combustion path to form a suspension containing mainly molten particles and the latter suspension is introduced into said cyclone chamber.

14. A pyrometallurgical process for reacting a particulate solid with a high-oxygen gas which comprises the steps of:

(a) reacting said solid with said gas in a vertical combustion tube to at least 80% of reaction completion to form a suspension containing mainly molten droplets and gas;

(b) introducing said suspension into a cyclone chamber and completing the reaction therein;

(c) recovering a metallurgical melt from said cyclone chamber through an opening in the lower portion of the shell;

(d) discharging through an outlet in an end wall of said cyclone chamber a gas stream entraining molten droplets;

(e) introducing a gas stream entraining molten droplets into a cooling chamber, the dimensions of said cooling chamber being sufficient to effect cooling of at least the surfaces of said droplets below the softening temperature thereof while said droplets are in free flight and before said droplets contact a wall of said cooling chamber; and (f) recovering flowable solid particles from said cooling chamber.

* * * * *